United States Patent [19]

Stafford

[11] Patent Number: 4,493,202

[45] Date of Patent: Jan. 15, 1985

[54] RAILROAD SPIKE FORGING MACHINE

[75] Inventor: Richard J. Stafford, Charlotte, N.C.

[73] Assignee: Stafford Rail Products, Inc., Lancaster, S.C.

[21] Appl. No.: 422,811

[22] Filed: Sep. 24, 1982

[51] Int. Cl.[3] ..... B21G 3/12; B21G 3/16; B21K 1/72

[52] U.S. Cl. ..... 72/353; 10/57; 10/59; 72/356; 72/361

[58] Field of Search ..... 10/56, 57, 58, 59, 61, 10/63; 72/353, 354, 360, 361, 427, 356

[56] References Cited

U.S. PATENT DOCUMENTS

| | | | |
|---|---|---|---|
| 576,536 | 2/1897 | Barr | 10/58 |
| 671,975 | 4/1901 | Parker | 10/56 |
| 685,477 | 10/1901 | Irwin | 10/57 |
| 1,025,670 | 5/1912 | Barr | 10/56 |
| 1,070,744 | 8/1913 | Stetter | 10/57 |
| 1,138,171 | 5/1915 | Ames et al. | 10/57 |
| 1,582,895 | 5/1926 | Berkley | 10/58 |
| 1,774,915 | 9/1930 | Crane | 10/57 |
| 2,023,636 | 12/1935 | Friedman | 10/63 |
| 3,299,451 | 1/1967 | Van De Meerendonk | 10/12 |
| 4,342,127 | 8/1982 | Weaver | 10/57 |

*Primary Examiner*—E. Michael Combs

*Attorney, Agent, or Firm*—David H. Semmes; Warren E. Olsen

[57] ABSTRACT

In a railroad spike forging machine of the type comprising a steel stock pointing roller assembly which longitudinally feeds pointed spike blanks along a centerline to a head forming station, a main die of hardened tool steel having a die zone defined between its leading edge and an intermediate point of said first longitudinal dimension, and a wipe zone defined between said intermediate point and the trailing edge of the die by a transversely extending entrance wall surface to the die zone, whereby a transverse wiping of the channel is enabled in said wipe zone. Further, a sensing means generates position signals from the rotation of a pointer roller, and a spike positioning mechanism comprises a first hydraulic cylinder operable transversely to extend a stop mechanism in response to a first position signal, thereby to stop forward motion of a spike blank at an appropriate distance downstream of the die leading edge. A spike ejection mechanism comprises a second hydraulic cylinder operable transversely to extend a side wiping assembly across the wipe zone in response to a second position signal.

6 Claims, 13 Drawing Figures

RAILROAD SPIKE FORGING MACHINE

BACKGROUND OF THE INVENTION

1. Field of the Invention

The present invention relates to improvements in a railroad spike forging machine, and particularly in the apparatus for forming the head on the railroad spike, and also ejecting the finished spike from the die.

2. Brief Description of the Prior Art

Manufacture of railroad spikes by forging steel stock is well known. Two primary types of railroad spike forging machines have long been used in this country. The first is known as a Barr spike machine, and a second type was manufactured by Youngstown Machine and Foundry Co. The present invention incorporates certain concepts from both the Barr and Youngstown machines, with respect to drive and supply of a square steel bar as raw material to a head forging location, while significantly modifying prior art techniques to insure an accurately formed spike at production rates previously considered impossible.

A Barr-type machine is illustrated, for example, by Barr, U.S. Pat. No. 1,025,670. A spike forging sequence on a Barr machine briefly will be described. Square steel bar sized $\frac{5}{8}$ inches (for 6 inch spikes) or 9/16 inches (for $5\frac{1}{2}$ inch spikes), in stock lengths typically 30 to 40 feet progressively is heated to a forging temperature by being passed through an induction heater, for example. The heated bar is indexed through a set of rotating pointer rolls, where a spike blank simultaneously is pointed and cut to a length adequate to enable a head to be formed and result in a spike of the proper length. A hot, pointed spike then is engaged by a set of powered feed rollers which accelerates the pointed blank longitudinally to a die area, where a mechanism momentarily stops the pointed blank at a leading edge position for forging the head. A gripper die engages the shank of the spike from above as a header die impacts onto the leading edge of the blank and forms the spike head. As the header and gripper mechanism move away from the formed spike, a bottom kicker device is actuated to elevate the leading edge of the spike upwardly out of the die, and hopefully into a position where a side kicker mechanism may push or reject the spike sideways, and out of the main die. Ideally, this sequence was accomplished rapidly, but in an indexing fashion, and with inherent problems. The main die and kicking arrangement could not react when a spike blank did not fully enter the main die, since the bottom kick would not sufficiently elevate the spike for the side kick mechanism to transversely remove the spike. Accordingly, the next blank indexed longitudinally from the accelerating rollers would over climb the misejected spike, and jam the machine. The circumstance of a spike blank not reaching an appropriate position in the die cavity so as to be raised properly by the bottom kick for a side wipe is referred to in the art as a "cobble".

Known machines and methods for making spikes are illustrated by the prior U.S. Patents, as follows:

| | |
|---|---|
| IRWIN | 685,477 |
| BARR | 1,025,670 |
| STETTER | 1,070,744 |
| BERKLEY | 1,582,895 |
| CRANE | 1,774,915 |
| FRIEDMAN | 2,023,636 |

-continued

| | |
|---|---|
| VAN DE MEERENDONK | 3,299,451 |

In addition to the above-listed prior art, FIGS. 1–3 of the present invention illustrate a recent design for a machine of the category upon which improvement is predicated herein, as designed for applicant's assignee by Wean United, Inc., Pittsburgh, Pa. The device illustrated in FIGS. 1–3 represents one starting point for understanding the present invention herein, in that this device could not achieve the results achieved after the specific improvements and modifications, which hereafter are particularly pointed out, were included. The prior art patents, as well as certain prior approaches illustrated at FIGS. 1–3, commonly evidence mechanical interconnections for cams and actuators, which have proven incapable of the exact timing of interrelationships required for the manufacturing speeds achieved herein. The present invention achieves tremendously increased production speeds by a theory of operation wherein a square steel rod continously is pointed and then accelerated into a main die cavity, and ejected before a subsequent blank arrives. In other words, the present invention is predicated upon a high-speed continuous throughput of pointed blanks to a downstream head forging location with a blank acceleration of sufficient speed into the main die to allow forging and ejection before a cobble of later blanks. To achieve this object, the present invention uses a stationary novel cooperation between bottom and side-kicking members which ensure a positive clearing of the die.

In contrast, the IRWIN patent teaches a spike making machine wherein a moving die is employed for an intermittent heading operation. Similarly, STETTER illustrates an approach to spike making wherein feed fingers pick-up a spike blank and position the blank between two movable die sections. BERKLEY illustrates an automatic pointing machine wherein electronics control an hydraulically actuated nipper arrangement, with a blank carried forward from feed roll to a heading position and dropped into a die channel, by the nippers.

CRANE illustrates a spike making machine wherein separate confining dyes and pointing dyes are employed to forge a spike, as shown more particularly at FIGS. 8–15. VAN DE MEERENDONK illustrates an upsetting head and an ejecting pin which cooperates with various movable parts required to eject the length, as shown in FIG. 2.

The present invention maintains a stationary die, while insuring ejection of the blank through a novel bottom kick and side wiping arrangement, which cooperates with a novel die construction. As previously discussed, the sequence of steps herein for forming a spike begins with pointing a blank, through pointer rollers which substantially function as the pointer rolls in the prior art spiking machine taught by FRIEDMAN. However, unlike FRIEDMAN, the present invention does not require moving main die sections, nor are the pointer rollers intermittently operated, as by a pawl and ratchet arrangement. Rather, the pointer rollers herein form spike blanks continuously, with an accelerating roller set accepting a pointed blank and accelerating it sufficiently to provide time for head forging and ejecting steps, before a following blank is accelerated into the die station.

A first object of the present invention is to provide a main die mechanism which will support the spike blank so that cobbling is greatly reduced, while also allowing increased rates of speed for spike production. A second object of the present invention is to configure a die ejecting mechanism which will enable a continuous throughput of steel blanks into the main die region, through accurate timing between pointing and forging steps. A synergistic cooperation between a continuous pointer roller motion and the accelerating roller mechanism is a necessary predicate to achieving both objects.

BRIEF SUMMARY OF THE INVENTION

The present invention generally comprises improvements to a machine of the category of the Barr spike machine, with certain characteristics of prior machines made by Youngstown Machine and Foundry Co. More specifically, FIGS. 1–3 illustrate the basic machine environment upon which the present invention predicates improvement, with this device hereafter referred to as the Wean United machine. The Wean United proposal to applicant's assignee also comprised a continuous pointing roller step, wherein square steel rod continuously was supplied into the pointer roller assembly, and pointed spike blanks therefrom accelerated into a main die cavity (of the Barr-type) where heading operation and ejection would take place prior to the arrival of a subsequent blank at the heading station. The present invention comprises improvement in this category of machine, through a novel main die and also a novel spike ejection mechanism, which cooperate synergistically in the machine environment. For example, the present invention has been operated at speeds in excess of 100 cycles per minute, with such high operating speeds directly attributable to the ability to ensure accurate cooperation between forging and ejection mechanisms and the pointer roller position.

A first predicate of the present invention was to ensure an accurate presenting of pointed blanks to the main die. Accordingly, a first aspect of the present invention was the modification of the machine of FIG. 1 so that the pointer rollers continuously and solidly would be driven. The present invention required a direct driving of the bottom pointer roll, with the upper pointer roll being maintained in alignment through a spur gear connection. Such an arrangement is per se known, as shown by the above-discussed FRIEDMAN patent. The Wean United approach had been to use separate trantorque drives to each pointer roll with mechanical cams for actuation of kick-out devices and stop mechanisms. Such cams and other mechanical linkages, as in FRIEDMAN, create gear backlash and inertial problems which result in a spongeyness which defeats the accuracy required for a design goal of over 100 cycles per minute. For example, unless the bar being pulled into the pointer roller assembly smoothly is accelerated at precise time intervals, without hesitation and chatter, the critical timing and longitudinal stopping of the blank in the main die for accurate head forging step cannot be achieved.

A second predicate of the present invention was to remove the various cam and linkage drives (not shown), for the pin actuators of FIG. 1. Instead, a transducer rotation position sensor upon the drive shaft to the driven pointer roller provides a set of signals to control rapid hydraulic actuation of all stop and kick-out actuators.

A related predicate to successful operation of the present invention in its intended environment was to employ a cantilevered pointer roller assembly, again per se shown by FRIEDMAN, wherein accurate alignment of the pointer tools can be achieved by virtue of the access to the pointer tools provided by such a cantilever arrangement. Since the bottom pointer roller rigidly is fixed to the machine base and driven directly through a simple transmission from a main flywheel, the upper pointer roll only need be adjustable, and driven by a spur gear from the lower pointer roller. Hence, a transducer sensing of lower pointer shaft rotation assures the required accuracy of the pointing operation, and timing of the ejection mechanism into a cooperation with the head forging, as now briefly will be described.

The pointer rollers eject a pointed spike blank at a linear speed less than 60 feet per minute, with the spike then being picked up by a pair of ejector rollers which instantaneously accelerate this blank to over 100 feet per minute, and directly into the main die cavity. The spike blank is stopped at an exact longitudinal position by a transversely moving stop mechanism, which retracts as a gripper mechanism comes down over the main die and a header die longitudinaly compresses the leading edge of the blank to form the spike head. Accordingly, the head forging step and a subsequent ejection must occur in milliseconds, if a following spike blank is not to cobble onto the preceeding spike. A significant discovery of the present invention is that the main die may fully be relieved on its trailing portion, leaving exposed a significant length of the spike shaft proximate the point, without affecting the quality of the resulting spike. This full side relief of the main die enables a bottom ejection pin hydraulically to be actuated to raise any length of the forward portion of the formed spike upwardly, as a side wipe then hydraulically is actuated to transversely eject the spike, regardless of spike position with respect to the main die. The side wipe comprises a triangular-faced trailing wipe surface and a separate rectangular-faced leading wipe surface, with both surfaces connected to a single hydraulic cylinder. Each cylinder can move through an approximate 3 inch stroke in less than 60 milliseconds, thereby supplying a sure and rapid side spike ejection regardless of spike misalignment in the main die. A transducer assembly senses pointer roller drive position and outputs electronic signals to servo valves which respond to a full open position in only 20 milliseconds. The transducer actuation, based directly upon the position of the lower pointer roller, has a response time of microseconds.

Further features and advantages of the present invention will become more apparent hereafter, wherein a preferred embodiment of the present invention is disclosed with reference to the accompanying drawings.

DESCRIPTION OF THE PREFERRED EMBODIMENT

Figure 1:
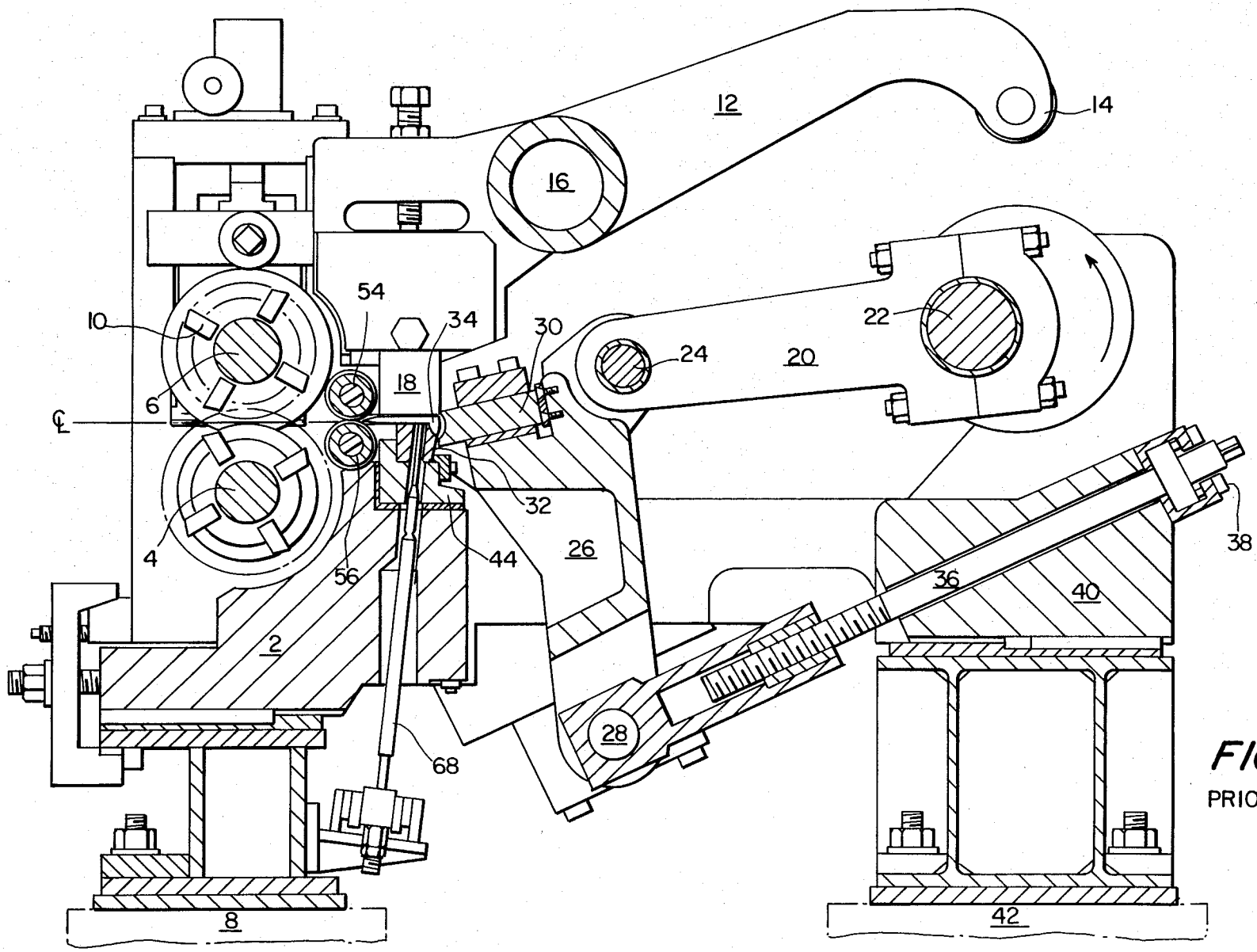
FIG. 1 PRIOR ART
FIG. 1 is a front view, partially in section, showing the Wean United prior art machine in a closed forging position.
Figure 2:
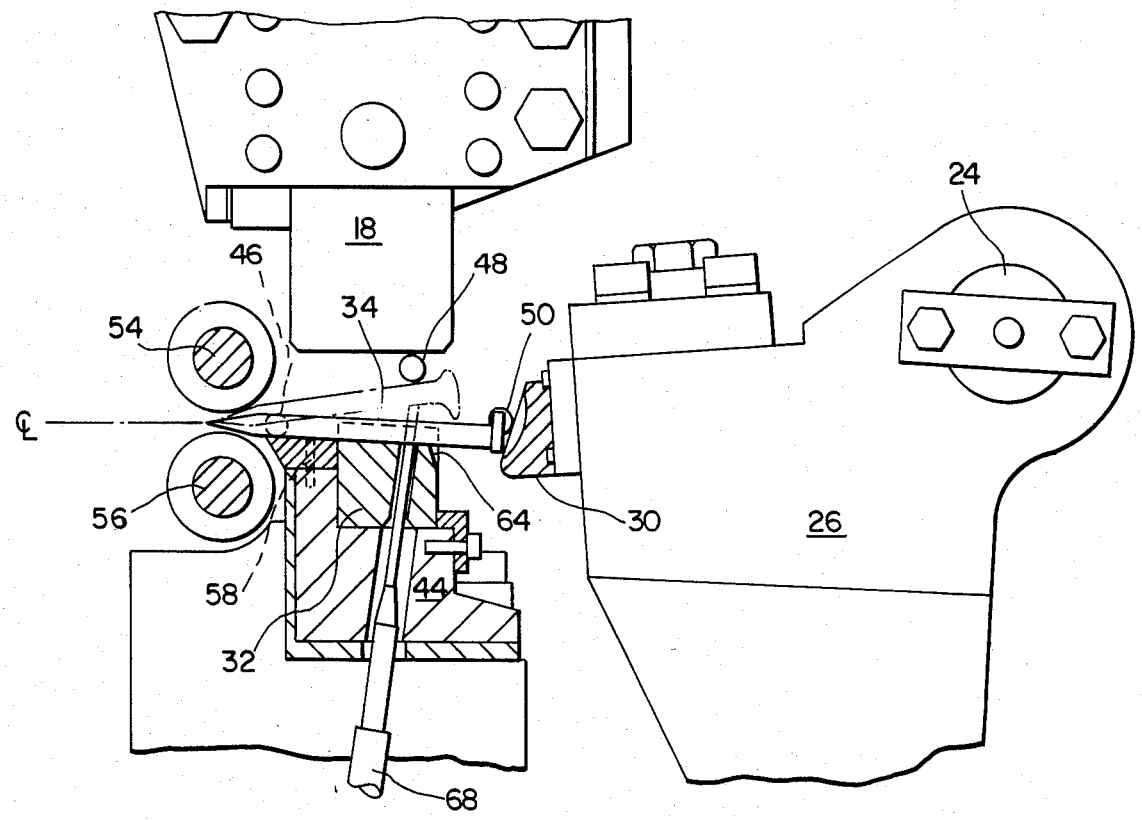
FIG. 2 PRIOR ART
FIG. 2 is a detail partial section front view of the device of FIG. 1, showing spike ejection.
Figure 3:
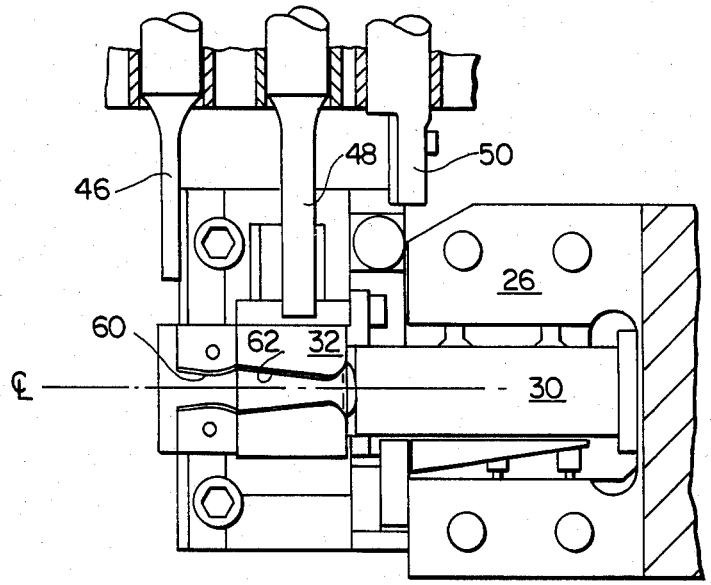
FIG. 3 PRIOR ART
FIG. 3 is a top view of the device of FIG. 1, showing a prior art Barr-type main die and a prior art mechanical ejection pin system.

FIGS. 1–3 illustrate the category of machine upon which the present invention teaches an improved main die, stop and ejection mechanism, and side wiper configuration. The FIGS. 1–3 device was manufactured for applicant's assignee by Wean United, Inc., Pittsburgh, Pa., with this machine incorporating known features from the Barr and Youngstown Machine and Tool, Inc. machines. As a background for improvements taught herein, a brief description of the mechanism illustrated in FIGS. 1–3 will be given, with further details of operation well known to those of ordinary skill, as shown by the above-discussed patents to Barr and Friedman.

The machine frame, 2, supports a lower pointer roller, 4, which cooperates with an upper pointer roller, 6, to pull in square steel stock, heated to red heat, and separate the stock into lengths characterized by a leading pointed edge and a trailing edge having a sharp point according to American Railway Engineering Association specifications, Part 2 (1968, as revised). The massive machine base, 3, is supported under the pointer roll stand by concrete supports, 8. According to the present invention, the lower pointer roller, 4, was modified in that it rigidly was mounted in the roll stand and continuously and directly driven through a simple gear transmission from a common machine drive motor (not shown). The lower pointer roller, 4, in turn drives the upper pointer roller, 6, through a spur gear (not shown) with both rollers cantilevered from the frame of the machine, to allow easy adjusting and changing of the individual pointing tools, 10. While cantilever pointer rollers per se are conventional, as shown by the Friedman patent, the direct and continuous drive of the lower roller so that square steel bar stock enters along the centerline pass of FIG. 1, is an operational distinction of importance to the present invention. Accurate control of the speed with which a pointed spike blank is sent downstream, to the head forging operation, is critical to prevent a cobble.

Additional conventional features in the environment of the present invention comprise a gripper arm assembly, 12, with a cam roller, 14, at one end, and a machine supported center of rotation, (not shown), in order to generate (with the main die) a gripping effect upon the top and bottom of the spike shaft through gripper block, 18. Similarly, a head die arm, 20, is connected to a crank shaft, 22, which is driven off the same shaft carrying the cam which engages gripper arm roller, 14. The head die crank arm, 20, acts through a bushing, 24, to rotate a header die holder arm, 26, about a lower fulcrum, 28, so as to urge a header die, 30, into a forging relationship with the main die, 32.

FIG. 1 shows a formed spike, 34, in position between the main and header dies, and held down in frictional engagement between gripper engagement block 18, and the main die, 32. Adjustment of the header die holder member, 26, contact angle is by a header die arm linkage, 36, which can be tightened or loosened by a torque device, 38. Movement of the lower fulcrum, 28, changes the orientation of the header die, 30, with respect to the impact point at the leading edge of the main die, 32. The machine frame 2, also is tied into the crank support, 40, which is supported by concrete pedestals, 42. The crank, 22, and the lower pointer roller, 2, are driven off of a common flywheel (not shown) which is driven by a motor of 25 horsepower through a belt drive arrangement known in the art, and also not illustrated.

FIG. 2, shows further detail of a prior art Wean United technique for releasing a spike from a Barr-type holder die, wherein two cam-driven side wipe actuation pins, 46, 48, transversely move to eject a spike. Additionally, a mechanically driven stop pin, 50, moves transversely, to the open position shown at FIG. 2. The finished spike leading edge thereafter can be raised by the bottom kick, 68, to a position proximate the leading eject pin, 48. The spike trailing or pointed end then is to remain just outside the main die guide block, 58, and proximate the trailing eject pin, 46. The spike blank is accelerated longitudinally along the centerline of passage by a pair of accelerating rollers, 54, 56, and stopped in the desired position by transverse interposition of the stop, 50. The accelerating rollers, 54, 56, as previously discussed, approximately double the linear velocity of a given pointed spike blank as it leaves the pointer roller assembly. The goal of this acceleration of continuously fed pointed blanks was to provide sufficient lead time to enable a subsequent need for a forging and ejection step prior to entry of the next blank. The present invention reduces that goal to practice.

The prior art main die assembly illustrated in FIGS. 2 and 3, comprised a main die body, 32, and an upstream guide assembly, 58. As most readily seen at FIG. 3, a spike blank would enter from the left along the centerline and first be guided by the channel, 60, in the guide block, 58. A converging channel, 62, of the main die, 32, then would lead the blank downstream towards the head recess, 64, at the leading edge of the main die. Accordingly, a pointed blank would contact two series of channels, as it was accelerated forward, to an ultimate rest position with the unfinished blank leading end resting against the transversely extended stop, 50. This prior art guide approach was believed necessary to ensure both accurate blank entry and to ensure that the gripper head, 18, with the main die body, would have sufficient mass to confine the spike as the head forging was performed. The header die, 30, exerts tremendous forces at the leading edge, 64, of the main die, 32, and a massive hardened tool steel main die was believed necessary to resist such loadings. However, it was found that a full relief on the main die proximate the blank spike end not only enabled a sweep form of trailing wiper, but also reduced opportunities for a cobble, even though no entry guide was provided. The guide channel, 60, in combination with the holder die channel, 62, presented varying and unpredictable frictional circumstances to the accelerating spike blank, so the blank often was delayed and stopped short of a timely contact with the momentary insertion of stop, 50. The long guide and main die channels also allowed hot scale to impede a smooth motion of the spike blank during both entry and ejection steps.

FIG. 2, illustrates how the bottom actuator pin, 68, might not always equally pivot the formed spike, 34, identically about its trailing edge, which should remain in the vicinity of trailing ejector pin, 46. The leading ejector pin, 48, often would not contact the spike at the same point in its arc. For example, a short-entry spike blank, or one otherwise not exactly in position would not transversely be pushed clear of the die as the leading pin, 48, moved transversely. It also readily can be appreciated that unless exact timing coordination was maintained between the bottom actuator, 68, the two side accuators, 46, 48, the reciprocating motions of the gripper, 18, and the header die, 30, the new blanks continuously being fed from the pointer rollers would cobble.

Figure 4:
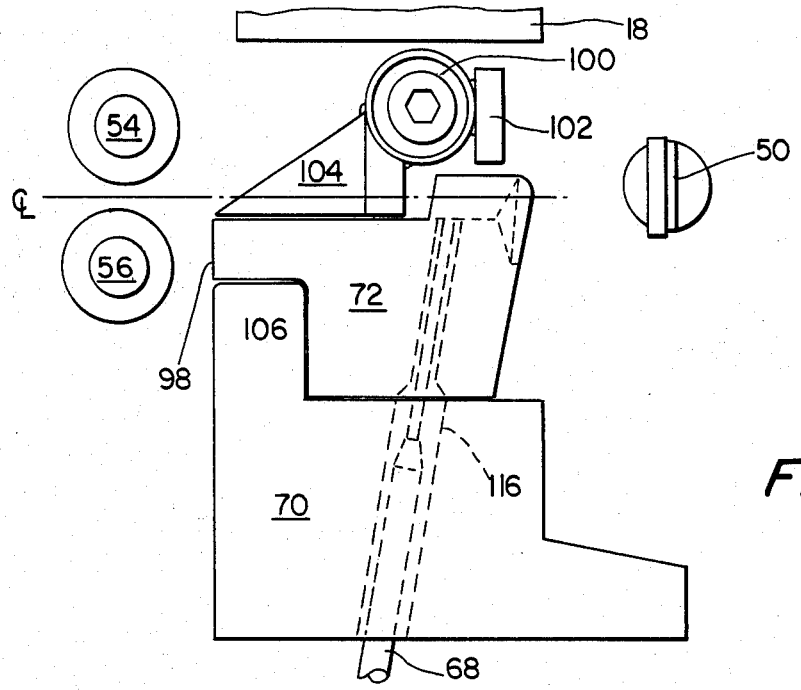
FIG. 4 is a side view showing the cooperation of a main die according to the present invention, with an hydraulically actuated side wiper assembly, also according to the present invention.

FIG. 4, illustrates in side view, a preferred embodiment of the present invention, wherein the accelerating rollers, 54, 56, feed a pointed spike blank along the indicated centerline, and against the stop provided by the intermittent motion of the stop, 50, as in the prior art device. FIG. 4 illustrates a new die holder, 70, a new main die, 72, as well as the juxtapositioning of a novel side ejection mechanism, 100, having a trailing wipe face, 104, and a leading wipe face, 102. Note also that the gripper head, 18, will contact the pointed spike blank over a substantial portion of its length, though the blank will not be constrained against side motion in the region of the transverse relief of the channel, i.e., the side wiping zone.

The improved spike forging machine environment of FIG. 4 further conventionally includes a bottom kick device, 68, which travels within a channel, 116, of the new main die holder, 70. Note also that the novel main die, 72, includes an extension, 78, which is spaced above an upper surface of the main die, as by a gap, 106. The upstream end of the die extension, 98, is not in bearing contact with any portion of the main die, for reasons hereafter explained.

Figure 6:
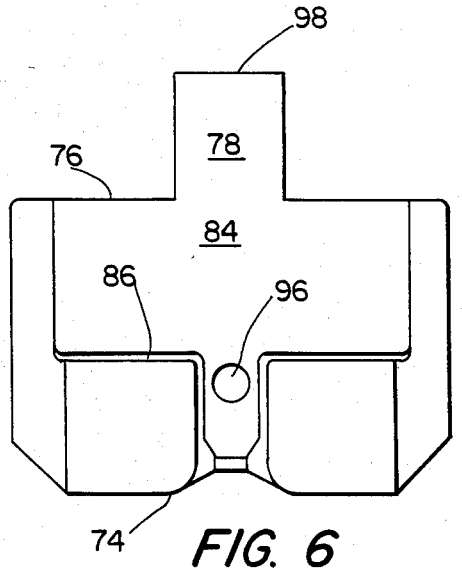
FIG. 6 is a top view of the preferred main die.
Figure 5:
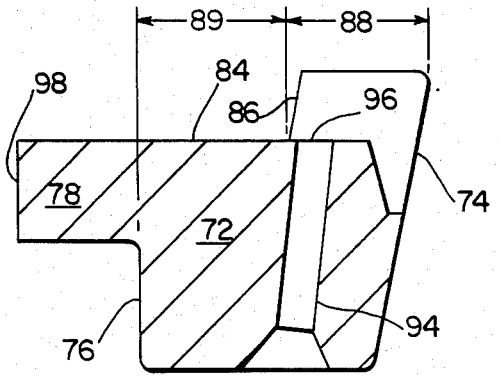
FIG. 5 is a side view, partially in section, of a preferred main die according to the present invention.
Figure 7:
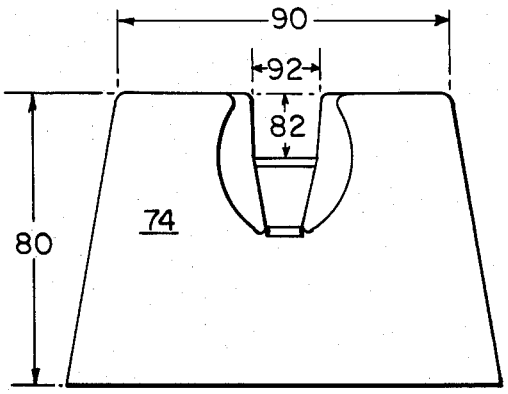
FIG. 7 is a front view of a preferred main die.

FIGS. 5–7, inclusive, illustrate a novel main die according to the present invention. The main die is one piece of hardened tool steel, with a first vertical dimension, 80, a first transverse dimension, 90, and a first longitudinal dimension between its leading edge, 74, and a trailing bearing edge, 76. In the preferred embodiment in FIGS. 5–7, the first longitudinal extent of the die comprises two zones, a die zone, 88, and a wipe zone, 89, with the die zone being defined between the leading edge and an intermediate point of the first longitudinal dimension defined by a transversely extending channel entrance surface, 86. The wipe zone in turn is defined by this channel entrance surface and a longitudinally extending channel entrance surface, 84, with these two surfaces together defining the transverse relief for the channel, having a depth, 82. Note also that the bottom kick is located in the channel at a location, 96, which is immediately adjacent to the entrance surface, 86, thereby to provide an upward kick for a spike blank at all within the die zone, with transverse ejection then assured by movement of the trailing wipe face, 104. The preferred embodiments of FIGS. 5–7 includes an extension, 78, which continues the channel entrance surface, 84. This extension has a transverse dimension narrower than the first transverse dimension, and is symmetrical about the centerline of the die.

As in the prior art die illustrated in FIGS. 1–3, the novel die of FIGS. 5–7, has a die zone defined by an upwardly open and longitudinally extending channel with a second transverse dimension, 92, and a second vertical or depth dimension, 82. A relief portion at the leading edge of the die, 74, is calculated to cooperate with the header die, to forge the appropriate head on a blank. As previously discussed, unless the stop, 50, accurately locates the overhang amount of a given spike blank, the head will be improperly sized during the forging operation. In order to increase the smooth throughput of a spike blank into a position against a momentary presentment of the stop, 50, the present main die has a smooth channel entrance surface, 84, which transversely is open upstream for the die zone region, proximate the leading edge of the main die. Hence, a substantial portion of the die channel is relieved as a transverse wipe zone. The flat die extension, 78, eliminates the need for any guide block, let alone the prior art guide block of FIG. 3, wherein a separate guide, 60, was required. It was found that such a separate guide surface, of a different steel, invariably had wear characteristics different than that of the main die, and, particularly where a die or a guide plate is not replaced at the same time. Hence, two discrete surfaces presented a slight ridge between the guide plate and the die, thereby further presenting changing friction conditions, and inconsistent motion of the blank into a proper stop position in the main die.

Figure 8:
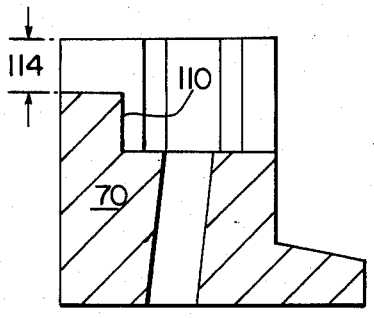
FIG. 8 is a side view, partially in section, of a preferred main die holder according to the present invention.
Figure 9:
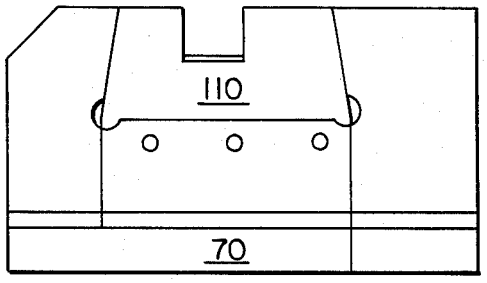
FIG. 9 is a front view of the preferred main die holder.
Figure 10:
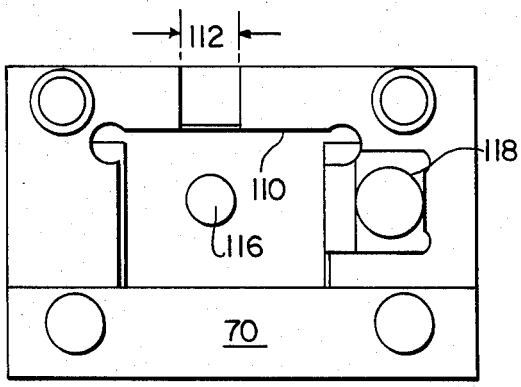
FIG. 10 is a top view of the preferred main die holder.

A novel die holder to accommodate the novel main die of FIGS. 5–7 is shown in FIGS. 8–10. Note that the trailing edge surface of the die, 76, is in bearing contact to a mating surface on the main die holder, 110. The holder further provides a dimension, 114, which ensures that an extension, 78, is maintained out of bearing contact with the holder, to prevent fracture of the die due to the tremendous impulse loadings imposed on the die during the forging operation. As shown in FIG. 9, a U-shaped bearing surface, 110, is presented against a similar mating surface, 76 of the main die, to distribute the longitudinal loading during the forging operation. Similarly, the transverse extension, 112, accommodates the extension, 78, without imposing any loadings on the extension. FIG. 10 illustrates a conventional mounting arrangement for holding the die against the holder.

Figure 11:
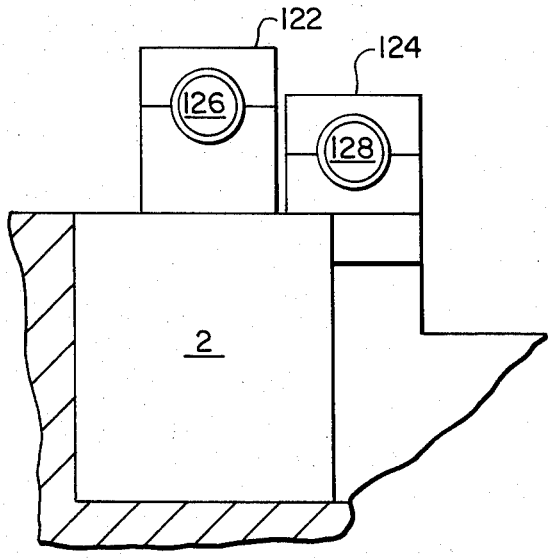
FIG. 11 is a side sectional view of a preferred hydraulic side wipe actuator mechanism and a preferred hydraulic stop actuator mechanism.
Figure 12:
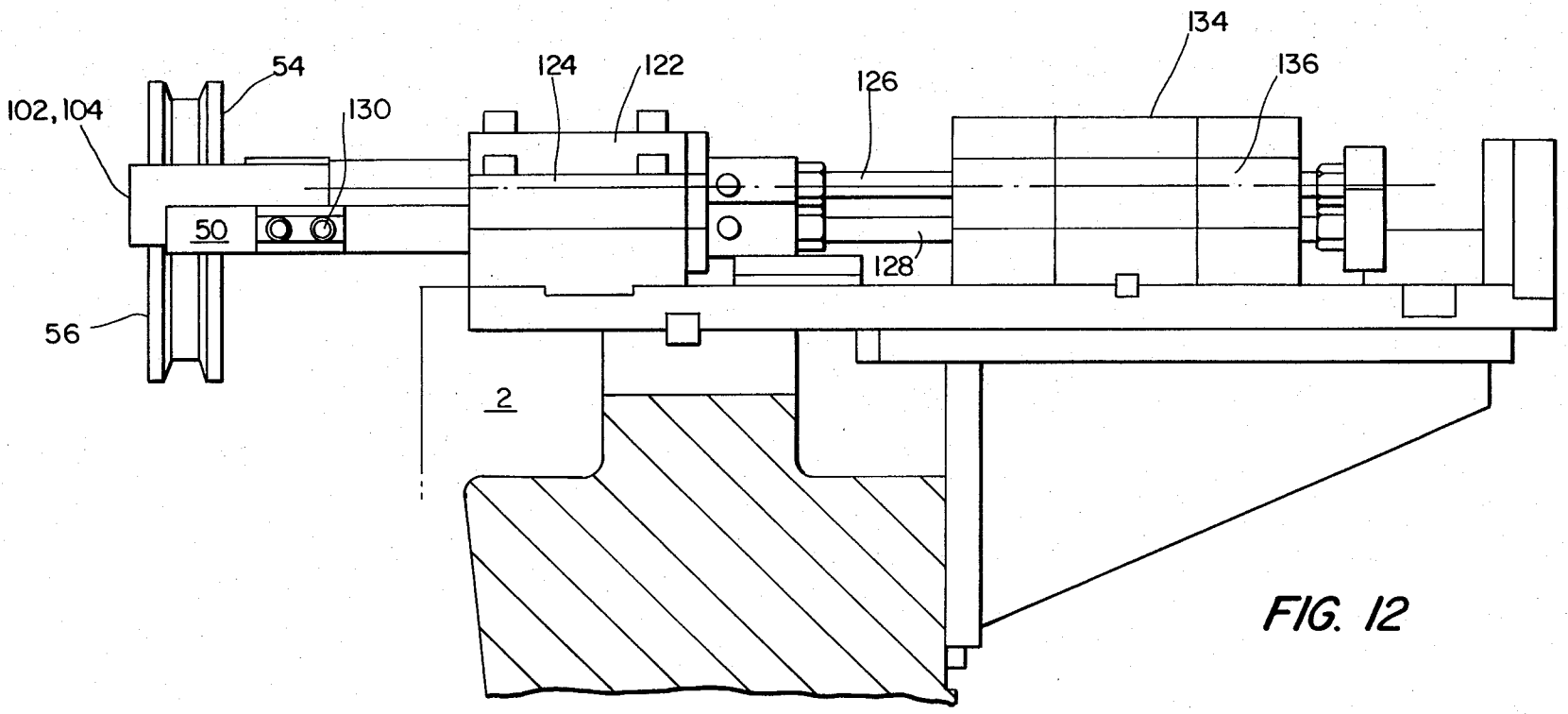
FIG. 12 is a right side view of the preferred side wipe and stop actuator.
Figure 13:
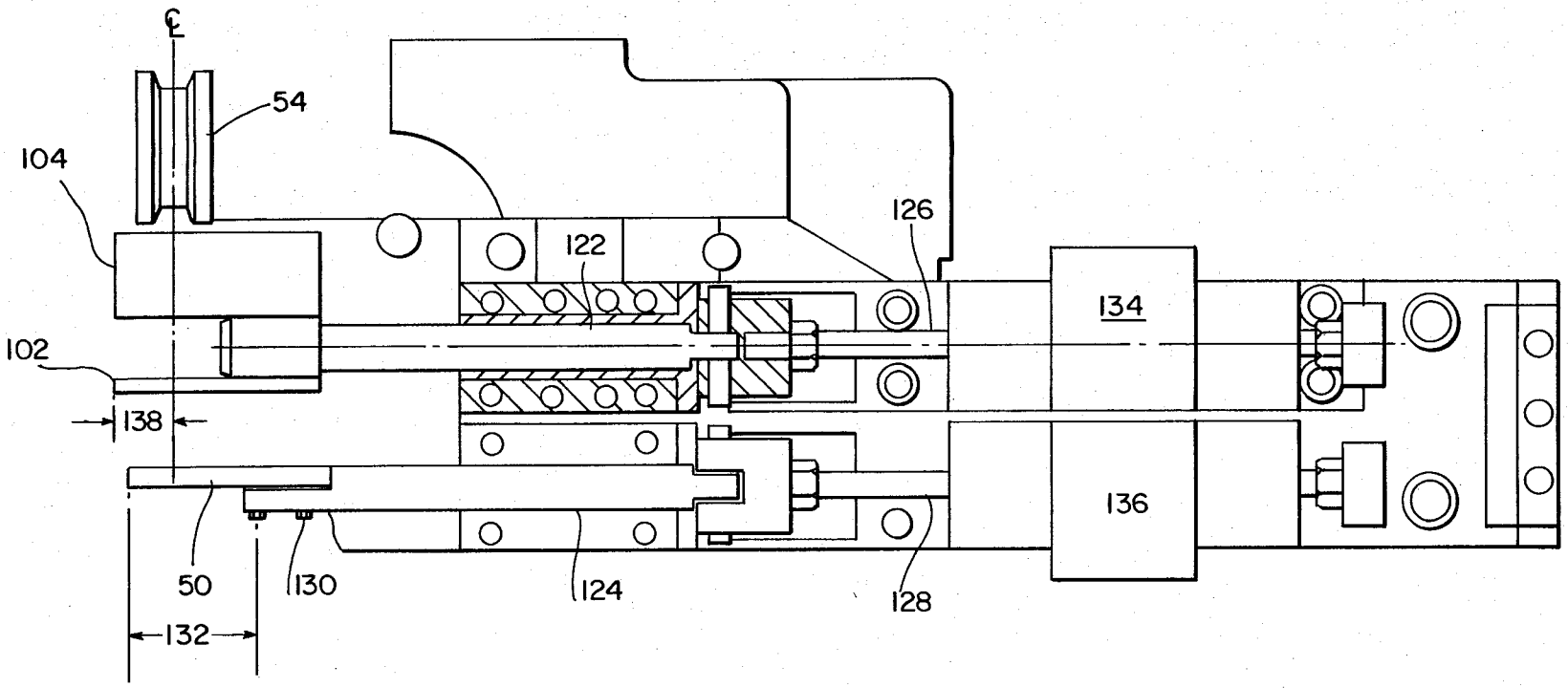
FIG. 13 is a top view of the preferred actuator mechanisms of FIG. 12.

FIGS. 11–13 illustrate the improvement in railroad spike forging machines which comprises the cooperation of sensing means to generate a position signal from the rotation of a pointer roller, and use of those signals for exactly timed transverse motions of both a stop mechanism, 50, and a side ejection mechanism. It should be appreciated that the side ejection mechanism separately is timed to the pointer roller mechanism, since very discrete position signals are generated by the transducer (not shown), so that a hydraulic actuation of the bottom-kick, 68, is also possible. In the prior art approaches of FIGS. 1–3, mechanical cams were used to control all such actuations, with the possibility of fine tuning each motion virtually nonexistent.

The stop position mechanism comprises a first hydraulic cylinder, 136, positioned downstream of the leading edge of the main die and operable to extend a stop mechanism, 50, in response to a first position signal from a transducer attached to the drive directly below the lower pointer roller, 4; with such a transducer being per se conventional, and not shown. As previously discussed, the present invention departs from the approach of FIGS. 1–3 by having the lower pointer roller, 4, directly driven by a transmission connection to the flywheel supplying general power to the machine, with the lower pointer roller, 4, being rigidly fixed so as to reduce the shock loadings transmitted through the frame of the machine. The upper pointer roller, 6, is in turn driven by a spur gear arrangement (not shown), off the direct drive to the lower pointer roller, 4. In this fashion, sloppiness and erratic loadings upon the frame of the machine, with consequential misalignments of parts, is greatly reduced.

The spike ejection mechanism comprises a second hydraulic cylinder, 134, positioned at a proximate end with a distal end adapted transversely to extend across the main die. The distal end further comprises a trailing wipe surface, 104, which has an edge position to wipe the relieved portion of the main die channel, as shown in FIG. 4. A separate leading wipe surface, 102, is spaced downstream therefrom, and positioned to wipe above the upwardly open channel, also as illustrated in FIG. 4. In the preferred embodiment, the trailing wipe surface further comprises a triangle, having a base dimension proximate the longitudinal extent of the relieved die portion, and a height dimension spaced from the entrance wall surface, 86, which is defined as a shoulder between the relieved or wiping portion of the main die, and the main die channel portion.

Accurate alignment for the first and second hydraulic shafts, 128, 126, is maintained by bearing guides, 122, 124 and fine tuning of the conventional stop plate, 50, is accomplished in the preferred embodiment by a simple mounting bolt arrangement, 130, as shown in FIG. 13. FIG. 13 also shows an approximate 3 inch stroke, 132, for the stop assembly, 50. The side wipe mechanism as shown spaced a distance, 134, over the centerline of the spike travel, in a full extended position, illustrates how a complete wiping of the trailing channel area is possible with the present invention.

The side view of FIG. 12 demonstrates the easy access for the respective cylinders enabled by the mounting, and the ease of connecting a conventional servo-valve hydraulic line system (not shown), to operate selectively each hydraulic cylinder, 134, 136, according to the principles of the present invention.

While a preferred embodiment of the present invention has been shown and described, the invention is to be defined by the scope of the appended claims.

I claim:

1. In a railroad spike forging machine of the type comprising a steel stock pointing roller assembly which longitudinally feeds pointed spike blanks along a centerline to a head forming station, where a gripper arm holds the blank in a main die as a heading die contacts and expands an unsupported leading edge of the spike blank against a recess in the leading edge of the main die, thereby to shape a spike head, the improvement which comprises;

a main die of hardened tool steel having a first vertical dimension, a first transverse dimension and a first longitudinal dimension between its leading edge and a trailing edge, wherein a die zone is defined between said leading edge and an intermediate point of said first longitudinal dimension, said die zone comprising an upwardly open and longitudinally extending channel, having a second transverse dimension and a second vertical dimension, wherein further a transversely open wipe zone is defined between said intermediate point and the trailing edge of the die by a transversely extending wall surface which further comprises a symmetrical entrance to the die zone, at said intermediate point and a longitudinally and transversely extending channel entrance surface, said die surfaces together defining an open transverse relief for the channel, whereby a transverse wiping of the channel is enabled across said entire wipe zone of the die.

2. In a forging machine according to claim 1, wherein said machine further comprises an upwardly extending bottom kick ejector pin passage which extends upwardly into said die zone channel at a second location to enable a bottom ejector pin to upwardly raise a finished spike above said channel, the improvement wherein the second location of said passage in the channel is substantially adjacent to the entrance wall surface of said die zone.

3. In a spike forging machine according to claim 1, wherein said main die wipe zone channel entrance surface further comprises an extension which is symmetrical to said entrance, and upstream from said main die trailing edge, wherein said surface is coextensive with said channel second depth dimension thereby providing a main die with a continuous guide surface in the wipe zone for a spike blank entering said die zone from said feed rollers.

4. In a spike forging machine according to claim 3, wherein said main die further has a transversely extending trailing edge surface defined as a bearing surface for contact to a mating surface of a main die holder, and said channel entrance surface extension has a third transverse dimension narrower than said first transverse dimension and symmetrical about the centerline of said die, and said extension has a third depth dimension narrower than said first depth dimension.

5. In a spike forging machine according to either claims 2 or 4, wherein means transversely to wipe said channel comprises a transversely extendable shaft having an actuator at a proximate end and a distal end adapted transversely to extend across said first transverse dimension of the main die, wherein said distal end further comprises a trailing wipe surface having edges positioned to wipe against the channel entrance surface of the wipe zone and a leading wipe surface spaced downstream and positioned to wipe over the die zone.

6. In a spike forging machine according to claim 5, wherein said trailing wipe surface further comprises a triangle having a base dimension proximate the longitudinal dimension of the wipe zone and a height dimension spaced from the depth dimension of the entrance wall surface.

* * * * *